United States Patent [19]

Edds et al.

[11] Patent Number: 5,003,139

[45] Date of Patent: Mar. 26, 1991

[54] CIRCUIT BREAKER AND AUXILIARY DEVICE THEREFOR

[75] Inventors: Thomas A. Edds; Willard J. Rezac, both of Lincoln, Nebr.; Thomas O'Carroll, Ballinasloe, Ireland

[73] Assignee: Square D Company, Palatine, Ill.

[21] Appl. No.: 462,388

[22] Filed: Jan. 9, 1990

Related U.S. Application Data

[63] Continuation-in-part of Ser. No. 374,037, Jun. 29, 1989.

[51] Int. Cl.[5] ..... H01H 71/04; H01H 71/52

[52] U.S. Cl. ..... 200/401; 200/400; 200/308; 200/323; 200/325; 335/017; 335/035; 335/166; 335/171

[58] Field of Search ..... 200/400, 401, 308, 323, 200/324, 325, 50 C; 335/160

[56] References Cited

U.S. PATENT DOCUMENTS

| | | | |
|---|---|---|---|
| 3,806,686 | 4/1974 | Gaskill | 200/308 |
| 3,820,046 | 6/1974 | Layton et al. | 335/13 |
| 3,863,042 | 1/1975 | Nicol | 200/308 X |
| 4,117,530 | 9/1978 | Reed et al. | 361/365 |
| 4,166,988 | 9/1979 | Ciancia et al. | 200/50 C |
| 4,301,342 | 11/1981 | Castonguay et al. | 200/400 |
| 4,315,231 | 2/1982 | Kondo et al. | 335/61 |
| 4,395,606 | 7/1983 | Zaffram et al. | 200/144 R |
| 4,609,895 | 9/1986 | Westermeyer | 335/17 |
| 4,644,122 | 2/1987 | Farley | 200/304 |
| 4,707,674 | 11/1987 | Harper | 335/160 X |
| 4,728,914 | 3/1988 | Morris et al. | 335/6 |
| 4,758,811 | 7/1988 | Slavin et al. | 335/234 |
| 4,774,484 | 9/1988 | Lehman et al. | 335/160 X |
| 4,788,621 | 11/1988 | Russell et al. | 361/115 |
| 4,794,356 | 12/1988 | Yu et al. | 335/13 |
| 4,796,154 | 1/1989 | Morris et al. | 361/353 |
| 4,800,460 | 1/1989 | Yin | 361/340 |

FOREIGN PATENT DOCUMENTS

| | | | |
|---|---|---|---|
| 2055249 | 2/1981 | United Kingdom | 200/308 |

*Primary Examiner*—Ernest G. Cusick

*Attorney, Agent, or Firm*—Larry I. Golden; Jose W. Jimenez; A. Sidney Johnston

[57] ABSTRACT

An accessory module (104) for use with a circuit breaker (10) is configured for mounting to the breaker, and has a rotor (142) which follows the movement of the circuit breaker blade (24) in the breaker by means of a coupling member (118) passing through a passage (110) in the circuit breaker wall. A portion of the rotor is configured as a cam (162) operating a switch (152) in the module, the switch thus giving a reliable indication of the position of the breaker blade. The breaker is preferably of the type which has a trip lever (50) carried on the breaker blade and mounted for slight movement thereon, and the rotor is preferably coupled to the trip lever. A solenoid (148) within the accessory module is disposed to rotate the rotor when energized, this rotation being coupled to trip the breaker to provide for remote tripping. Since the trip lever is carried with the breaker blade, the blade position is monitored by the switch.

15 Claims, 6 Drawing Sheets

24
62
43
43a
54
26
24a
48
60
100
111
28c
28a
28b
28
52
63
56
50
72
76
74
44
44a
42
58
78
70
40
69b
64
88
66
66a
69
45
45a
68
65
89
103

FIG. 12
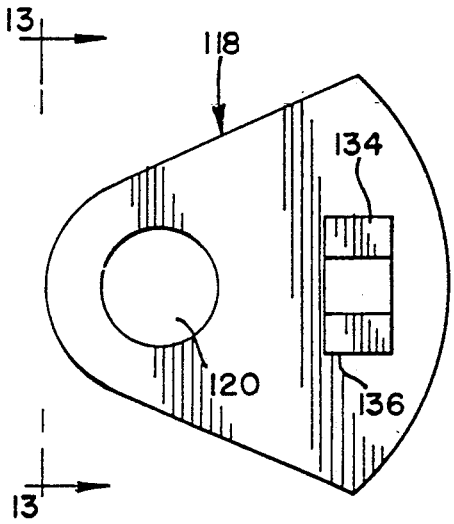
FIG. 13
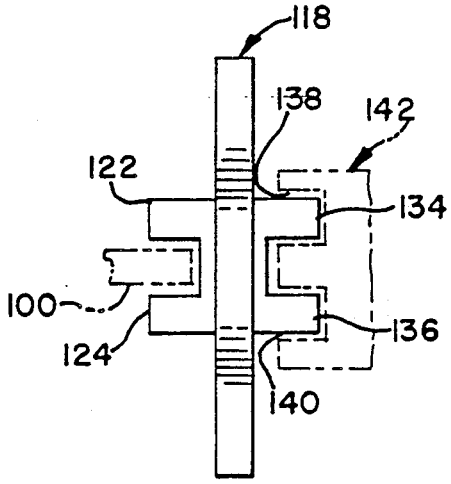
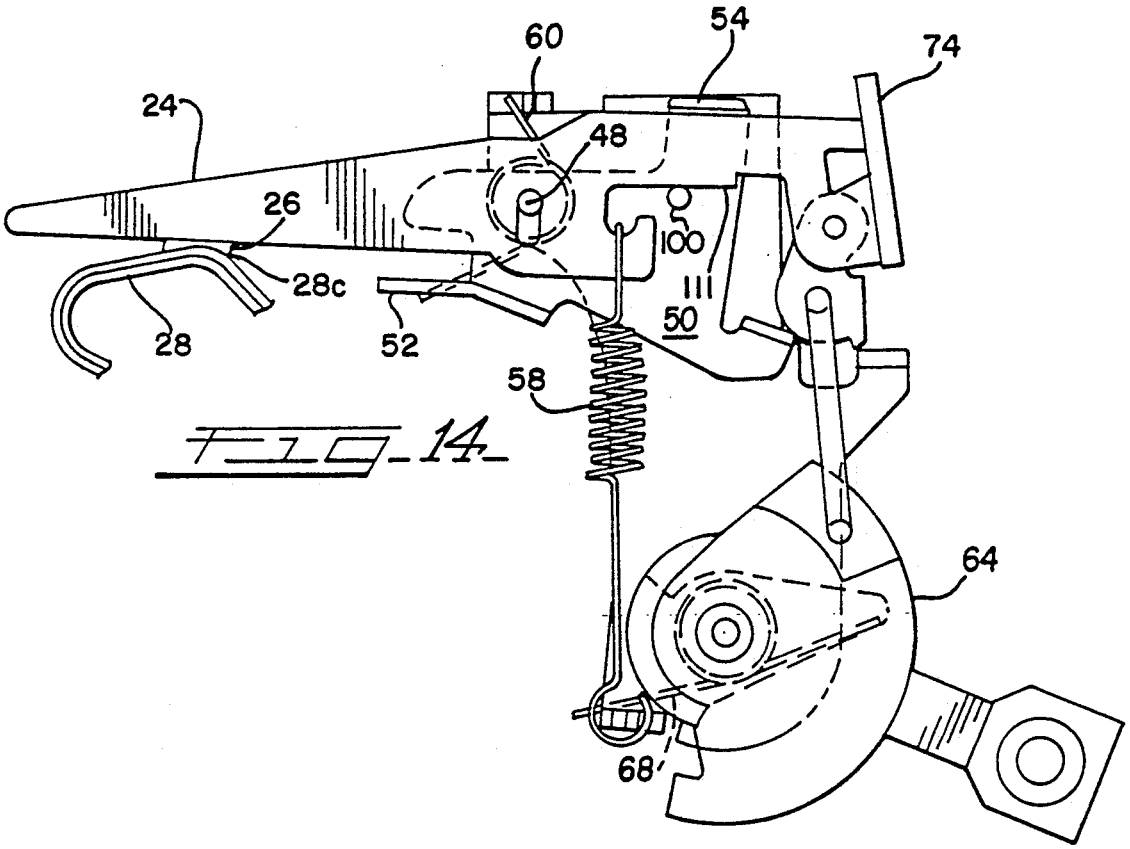
FIG. 14

CIRCUIT BREAKER AND AUXILIARY DEVICE THEREFOR

RELATED APPLICATIONS

This application is a continuation-in-part of U.S. application Ser. No. 374,037 filed June 29, 1989.

TECHNICAL FIELD

The invention relates to circuit breakers and to accessory modules therefor.

BACKGROUND PRIOR ART

A safety hazard exists in certain forms of circuit breakers in that if the breaker blade contacts should fuse together, then the tripping mechanism on overload will still respond, typically driving the reset handle to a center position indicative of tripping, while the breaker still remains in a circuit-completing or closed contact condition.

Systems are known, such as disclosed in U.S. Pat. No. 4,794,356, which provide in the form of a modular accessory a position-indicating switch coupled directly to the movement of an electrical circuit breaker contactor. The systems provide sensing conditions indicative of the contact condition of the breaker, thus providing means for warning the user that the breaker has not, in fact, been effectively tripped in the event that the blades have become welded shut. In this system such a switch is coupled to be actuated directly by movement of the contactor element itself.

Additionally, in many cases it is desirable to provide a remote-tripping feature for a breaker whereby a remote operator can operate the breaker to a tripped condition. Such mechanisms are also known, being frequently provided in modular form, and normally utilize a member which operates on the latching mechanism which holds the breaker in the reset condition. A unit which can be optionally affixed to a circuit breaker to achieve both functions, and requiring only a single coupling element, thereby reducing system complexity, would be a useful feature that has not, to the applicant's knowledge, been thus far produced.

The present invention is provided to solve these and other problems.

SUMMARY OF THE INVENTION

According to features of the invention, a breaker housing is modified to provide an access passage exposing a portion of the breaker blade mechanism to external access, and a bolt-on accessory module contains in the preferred form a rotor coupled to a movable coupling member configured to extend through the breaker passage to engage a portion of the blade mechanism. A member carried with the blade mechanism, and preferably mounted on a trip arm carried with the blade, extends towards the passage to engage with the coupling member. A sensing switch within the accessory module is engaged by a camming surface on the rotor so that the rotor will be moved responsively to tripping and resetting of the breaker blade to indicate the true position of the breaker contacts. By engaging the breaker blade via the trip lever of the breaker, rotation of the rotor when the breaker is in the reset position will trip the breaker. Accordingly, a solenoid is also provided in the module configured to engagingly rotate the rotor in the tripping direction. There is thus provided by means of a single coupling element not only a sensing of the true state of the breaker, but also means for remotely tripping it.

Other features and advantages of the invention will be apparent from the following specification taken in conjunction with the following drawings.

BRIEF DESCRIPTION OF DRAWINGS

FIG. 12 is a plan view of the coupling member shown in FIG. 6;

FIG. 13 is a side elevation view of a coupling member shown in FIG. 12; and FIG. 14 is a view similar to FIGS. 2 and 3, showing the breaker assembly 40 in the tripped condition with the contacts welded together.

DETAILED DESCRIPTION

Figure 1:
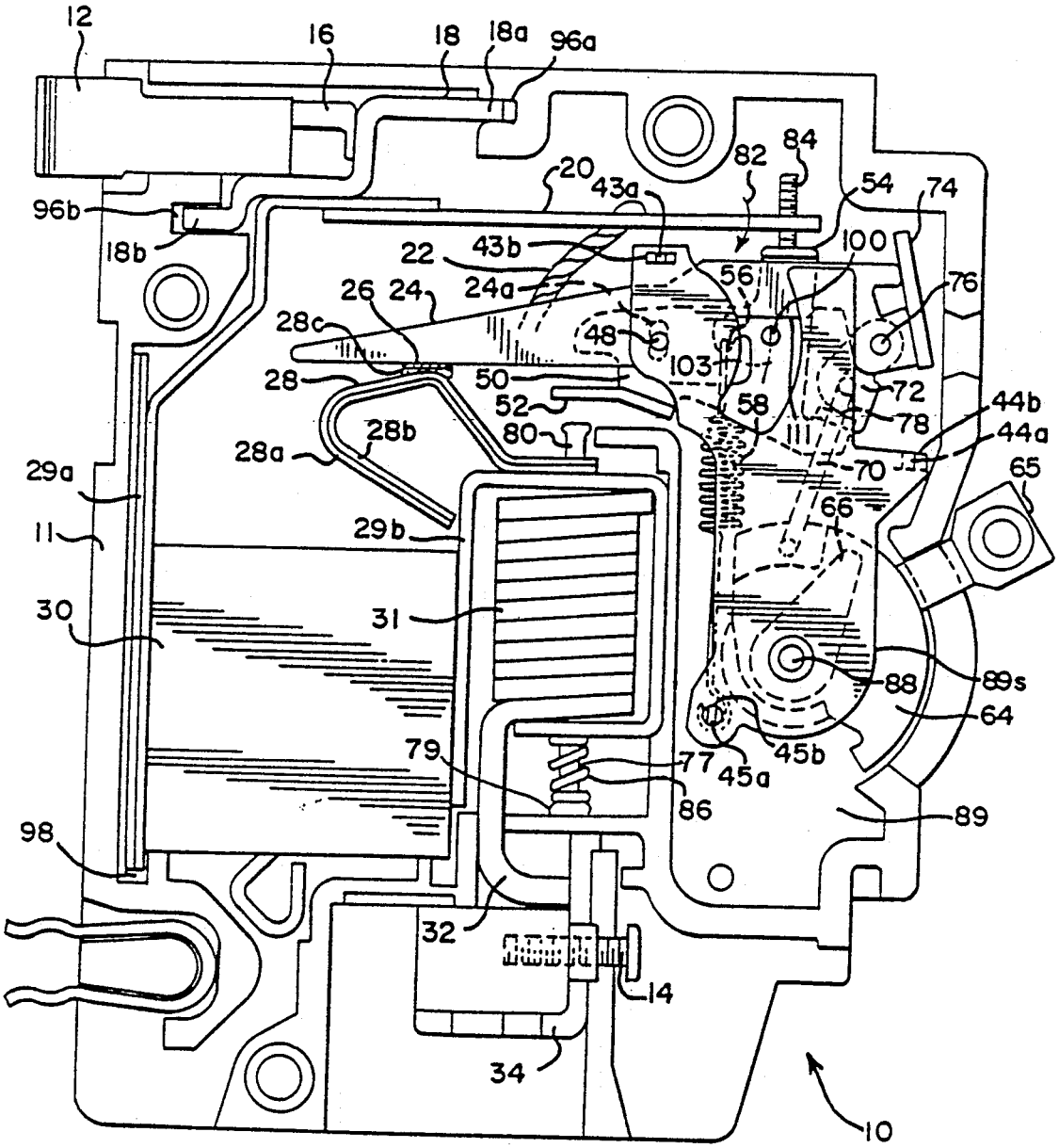
FIG. 1 is a view of a circuit breaker according to the invention.

While this invention is susceptible of embodiments in many different forms, there is shown in the drawings and will herein be described in detail, a preferred embodiment of the invention with an understanding that the present disclosure is to be considered as an exemplification of the principles of the invention and is not intended to limit the broad aspects of the invention to the embodiment illustrated.

A circuit breaker 10 is illustrated in FIG. 1.

An additional description of general aspects of a circuit breaker can be found in the following patents, the specifications of which are specifically incorporated herein by reference:

A. Westermeyer, U.S. Pat. No. 4,617,540, entitled "Automatic Switch, Roll-Mounted", B. Westermeyer, U.S. Pat. No. 4,614,928, entitled "Automatic Switch with an Arc Blast Field", C. Westermeyer, U.S. Pat. No. 4,609,895, entitled "Automatic Switch with Integral Contact Indicator", and D. Westermeyer, U.S. Pat. No. 4,608,546, entitled "Automatic Switch with Impact-Armature Tripping Device".

The circuit breaker 10 has a housing 11 and includes a line terminal 12 for coupling to a source of electricity (not shown) and a load terminal 14 for coupling to a load (not shown). A current path is established between the line terminal 12 and the load terminal 14 which includes as elements a line conductor 16, a bimetal support 18, a bimetal thermal element 20, a braided pigtail 22, and a blade 24 including a movable contact 26.

Continuing from the movable contact 26, the current path includes a stationary contact 28, a coil 31, a conductive link 32, a load conductor 34, and ultimately the load terminal 14.

The blade 24 is illustrated in FIG. 1 in a closed position, wherein the moveable contact 26 contacts the stationary contact 28. As discussed below with respect to FIG. 3, the blade 24 is pivotable to an open position, wherein the movable contact 26 is spaced from the stationary contact 28, preventing current flow between the movable contact 26 and the stationary contact 28. The stationary contact 28 comprises a copper layer 28*a* laminated to a steel layer 28*b* with a silver/graphite composition contact 28*c* welded to the copper layer 28*a*.

The blade 24 is an element of a unitary breaker assembly generally designated 40 which controls the position of the blade 24 relative to the stationary contact 28.

The circuit breaker 10 also includes a line-side arc arresting plate 29*a*, a load-side arc arresting plate 29*b* and a stack of deionization plates, or arc stack, 30, which cooperate to break an arc formed when the circuit breaker 10 opens under load. The specific operation of the line- and load-side arc arresting plates 29*a*, 29*b*, respectively, in conjunction with the arc stack 30 is disclosed in greater detail in the above incorporated patents.

Figures 2, 3, 4:
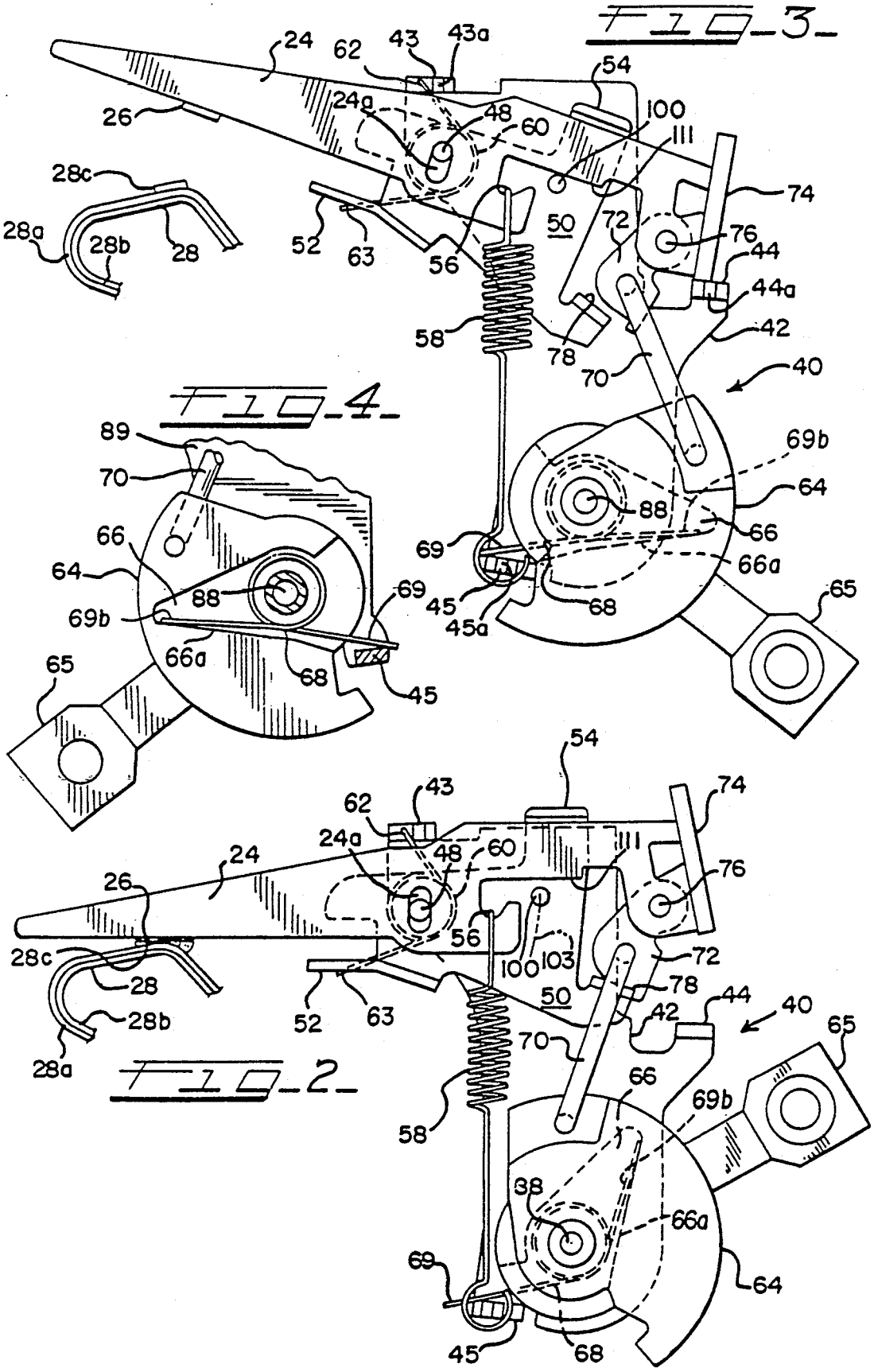
FIG. 2 is a view of a unitary breaker assembly according to the invention in a closed contact position.
FIG. 3 is a view of the unitary breaker assembly of FIG. 2, shown in an open contact position.
FIG. 4 is a view of a cam as viewed from behind the unitary breaker assembly of FIGS. 2 and 3.

The unitary breaker assembly 40 is illustrated in FIG. 2 with the blade 24 in the closed position in contact with the stationary contact 28.

The unitary breaker assembly 40 includes a first frame plate 42 which forms a first frame surface. The first frame plate 42 includes first, second and third upright members 43, 44, 45, respectively. A pivot pin 48 extends upwardly through a hole in the first frame plate 42. A trip lever 50 is mounted on the pivot pin 48 through a trip lever opening. The trip lever 50 includes a solenoid actuator surface 52 and a bimetal actuator surface 54. The blade 24 includes an elongated slot 24*a* for receiving the pivot pin 48. The blade 24 further includes a notch 56 to which a first end of a toggle spring 58 is attached.

A latch spring 60 is disposed on the pivot pin 48 between the trip lever 50 and the blade 24. The latch spring 60 includes a first end 62 which engages the first upright member 43 and a second end 63 which engages the solenoid actuator surface 52 of the trip lever 50. The latch spring 60 provides a counter clockwise bias to the trip lever 50.

A cam 64 has an operating handle 65 and further includes a recessed portion 66 in which a cam spring 68 is placed, as discussed in greater detail below with reference to FIG. 4. A first cam spring end 69*a* extends out of the recessed portion 66 and engages the third upright member 45. A second cam spring end 69*b* is retained in the recessed portion 66. The cam spring 68 maintains a clockwise bias of the cam 64 as viewed in FIG. 2.

A link 70 connects the cam 64 to a pawl 72. The pawl 72 is pivotally connected to a flag end 74 of the blade 24 by a shoulder rivet 76.

The trip lever 50 further includes an engaging surface 78 which engages the pawl 72.

When in the closed position, as illustrated in FIG. 2, the movable contact 26 is in a contacting relationship with the stationary contact 28. The shoulder rivet 76 operates as a fulcrum on the blade 24, causing the toggle spring 58 to securely maintain the movable contact 26 in contact with the stationary contact 28.

Referring again to FIG. 1, the blade 24 can be moved to the open position by operation of either the bimetal thermal element 20 or by a spring loaded rod 80 disposed within the coil 31. The breaker can also be operated by means of the operating handle 65.

As current passes between the line terminal 12 and the load terminal 14, it passes through the bimetal thermal element 20. As is well known in the art, the current causes the bimetal thermal element 20 to heat, and the heat causes the bimetal thermal element 20 to deflect downwardly in the direction of arrow 82. The extent of the deflection depends on the magnitude of the heating of the bimetal thermal element 20, and hence depending upon the magnitude and length of time of the current passing between the line terminal 12 and the load terminal 14.

When the bimetal thermal element 20 deflects sufficiently, a calibration screw 84 engages the bimetal actuator surface 54 of the trip lever 50, causing the trip lever 50 to rotate clockwise about the pivot pin 48 and against the bias of the latch spring 60, tripping the circuit breaker 10, as discussed in greater detail below.

The circuit breaker 10 can also be tripped by the coil 31. A ferromagnetic impeller 77 is slidably movable along the interior axis of the coil 31, and is held in the extended position shown in FIG. 1 by a biasing spring 86 urging the impeller against a stop 79. An insulating actuating rod 80 is similarly axially movable along the central core of the coil 31 and extends out of the opposite end thereof. The lengths of the rod 80 and the impeller 77 are chosen so that with the impeller drawn up into the solenoid passage the rod 80 will be forced upward into engagement with a solenoid actuator surface 52 formed by a portion of the trip lever 50. Thus, current passing between the line terminal 12 and the load terminal 14 passes through the coil 31 establishing an electromagnetic field affecting the impeller 77. When the electromagnetic force acting on the impeller 77 exceeds the biasing force of the biasing spring 86, the impeller moves upwardly against the interior end of the rod 80, forcing it to engage the solenoid actuator surface 52, causing the trip lever 50 to rotate clockwise, tripping the circuit breaker 10, as discussed below.

Referring again to FIG. 2, when either the bimetal thermal element 20 or the rod 80 cause the trip lever 50 to rotate clockwise, the engaging surface 78 of the trip lever 50 moves away from engagement with the pawl 72. When the engaging surface 78 moves away from engagement with the pawl 72, biasing from the handle spring 68 causes the cam 64 to rotate clockwise. As the cam 64 rotates clockwise, the cam 64 pulls downwardly upon the link 70, causing the pawl 72 to rotate counter clockwise about the shoulder rivet 76.

As illustrated in FIG. 3, when the pawl 72 is released from engagement with the engaging surface 78, the blade 24 moves downwardly at its right side, initially causing the pivot pin 48 to engage the upper surface of the elongated hole 24, which operates as a floating point. The pivot pin 48 then operates as a fulcrum about which the blade 24 rotates, causing the toggle spring 58 to move the movable contact 26 away from the stationary contact 28, thus opening the circuit.

In the event that the operating handle 65 is locked in the upward or on, position, and either bimetal thermal element 20 or the rod 80 causes the trip lever 50 to rotate clockwise, the link 70, which is under compression between the cam 64 and the pawl 72, causes the pawl 72 to rotate clockwise about the shoulder rivet 76, again releasing the engaging surface 78 from engagement with the pawl 72. When the engaging surface 78 no longer engages the pawl 72, the blade 24 lowers, again causing the pivot pin 48 to operate as a fulcrum about which the blade 24 rotates, permitting the toggle spring 58 to again move the movable contact 26 away from the stationary contact 28.

The cam 64 is shown from its reverse side in FIG. 4 to better illustrate the recessed portion 66 and the cam spring 68.

The cam spring 68 is centered on a cam axis 88. The second cam spring end 69*b* is held against a wall 66*a* of the recessed portion 66. The first cam spring end 69*a* is held against the third upright member 45 under torsional loading. The loading of the cam spring 68 biases the cam 64 and the operating handle 65 in the downward position.

Figure 5:
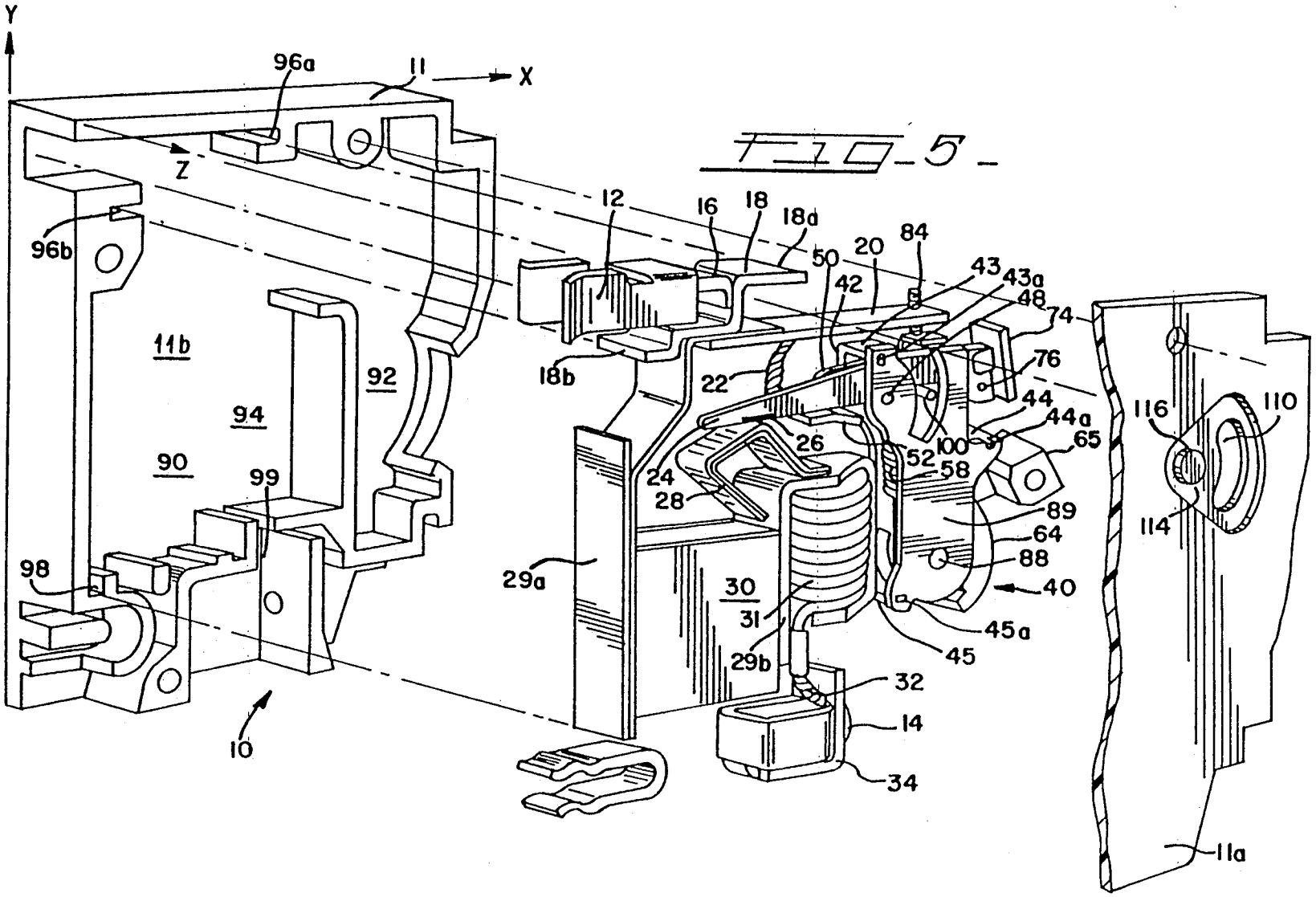
FIG. 5 is an exploded perspective of the circuit breaker of FIG. 1.

The circuit breaker 10 is illustrated in an exploded perspective view in FIG. 5. The first, second and third upright members 43, 44, 45 of the first frame plate 42 terminate with connecting tabs 43*a*, 44*a*, 45*a*, respectively. A second frame plate 89 forms a second frame surface 89*s* which includes corresponding tab receiving openings 43*b*, 44*b*,45*b*. The tab receiving openings 43*b*, 44*b*, 45*b*, receive and provide an interference fit with the connecting tabs 43*a*, 44*a*, 45*a* to secure the first frame plate 42 to the second frame plate 89. The first frame plate 42 cooperates with the second frame plate to form an assembly frame. In the preferred embodiment the first and second frame plates 42, 89, respectively, are separate pieces; however it is to be understood that the assembly frame could be formed from of a single piece folded over to form the opposing frame surfaces without departing from the spirit and scope of the present invention. With the first frame plate 42 secured to the second frame plate 89, all elements of the unitary breaker assembly 40 are secured together.

As illustrated in FIG. 5, operating elements of the circuit breaker 10 can simply be dropped into the circuit breaker housing, and require no special attachment thereto.

The housing 11 has a base 11*b* and a cover 11*a*. The base 11*b* defines an x-y plane and includes internal walls directed perpendicular to the base 11 along a z-axis. The internal walls define generally an arc stack section 90, a unitary breaker assembly section 92 and coil section 94.

End portions 18*a* and 18*b* of the bimetal support 18 are slid into and retained within respective bimetal support slots 96*a*, 96*b*. The line-side arc arresting plate 29*a* is slid into and retained within an arc runner slot 98. The unitary breaker assembly 40 is then simply placed in the unitary breaker assembly section 92, and requires no attachments to the housing 11. The load conductor 34 is slid into and retained in a load conductor slot 99.

The blade 24 is a tapered plate on edge, operating structurally as a beam so as to prevent flexing. If additional current carrying capacity is required, the width of the blade 24 is simply increased.

It will be recalled that clockwise rotation of the trip lever 50 by the bimetal element 20 trips the breaker, causing the breaker assembly 40 to be tripped from the contacts closed position shown in FIG. 2 to the contacts open position shown in FIG. 3. A tripping pin 100 is affixed to the trip lever 50 and extends perpendicularly outwardly therefrom, through a cut-out 111 in the blade 24. Upon tripping, the pin 100 will follow the arcuate path 103 shown in dotted outline in FIG. 2. From the previous discussion, it is equally clear that if the tripping pin 100 is urged downward (see FIGS. 1, 2 and 3) for any reason, tripping of the breaker assembly 40 will also occur by rotation of the trip lever 50.

It will be further noted that in all cases, the pin 100 is effectively carried along with the blade 24 so that the position of the pin 100 thus indicates whether the breaker is in a contacts closed or contacts open condition. In both FIGS. 2 and 3, the pin 100 is located slightly below the edge of the cut-out portion 111 of the blade 24. Assume the breaker the breaker in the reset position shown in FIG. 2 has its contacts 26 and 28 welded together. Upon any clockwise rotation of the trip lever 50, pawl 72 disengages from the engaging surface 78 of the blade 24 but, the blade, 24 is prevented from rotation by the welded contacts 26 and 28 although minimal clockwise movement of the blade 24 occurs until it is arrested by engagement with pin 48. (see FIG. 14) The locking engagement between the pawl 72 and the engaging surface 78 having been released, the cam 64 immediately rotates clockwise under the force of the cam spring 68, unsuccessfully attempting to rotate the blade 24 clockwise, and finally adopting the intermediate position shown in FIG. 14. The trip lever 50 is urged counter-clockwise by the force of its biasing spring 60; however, the immediate engagement of the pin 100 with the edge of the cut-out portion 111 prevents such motion. There is thus negligible movement of the pin 100 under such circumstances.

Thus, a slight movement of the pin 100 will cause the engaging surface 78 to release from engagement with the pawl 72. In the event that the contacts 26, 28 are not welded shut, the subsequent position of the pin 100 will serve as a positive indication that the breaker assembly 40 has in fact been operated to an open contacts condition. Thus, pin 100 may be used to trip the breaker, and may also serve as a sensing element indicating the subsequent status of the contacts.

Use is made of the foregoing to allow the employment of an add-on accessory module 104 which can be provided with a position sensor indicating the position of the pin 100 and which also includes an actuating mechanism for providing remote tripping of the breaker assembly 40. To achieve this, the housing cover plate 11*a* (FIG. 5) is provided with an arcuate slot 110 providing access to the end of the pin 100 along its entire range of movement.

Figure 6:
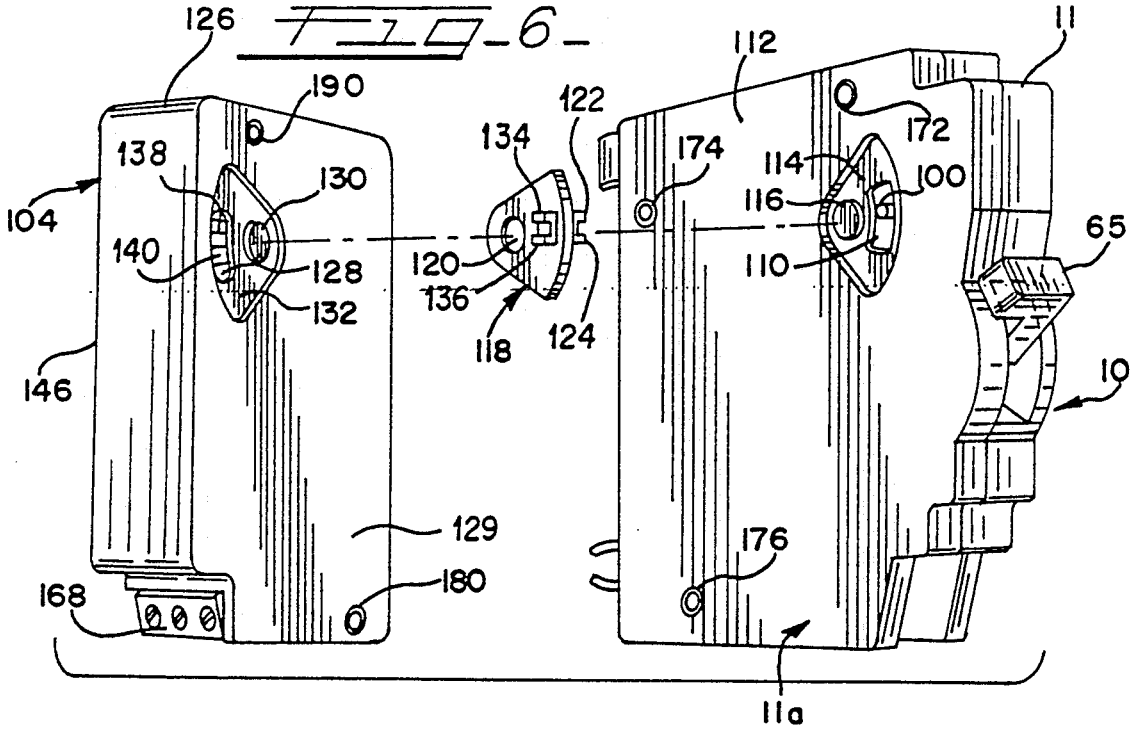
FIG. 6 is an exploded view showing an add-on modular device assembly, a coupling member, and a modified breaker of the present invention.

Thus, referring also to FIG. 6, the outer surface 112 of the housing cover 11*a* has a recess 114 in the form of a circular sector having the slot 110 generally close to one edge thereof, and having a cylindrical post 116 outwardly extending from the surface of the recess 114, the post being positioned to be generally co-axial with the pivot pin 48 of the breaker assembly 40. A coupling member 118 (see also FIGS. 12, 13) is similarly configured as a planar circular sector and has a guide hole 120 at the radius point that is configured to accept the post 116. A pair of pin-engaging bosses, 122, 124 extend outward from one face of the coupling member 118 and a similar pair of bosses 134, 136 extend outward from the opposite face of member 118. The coupling member 118 is configured so that when mounted on the post 116, the bosses 122, 124 are disposed on either side of the pin 100 as indicated by dotted outline in FIG. 13. Thus rotation of the coupling member 118 will trip the circuit breaker assembly 40, and the movement of further pin 100 during tripping will further rotate the coupling member 118.

The accessory module 104 includes a housing 126 having an outer face 129 configured for flush engagement with the outer face 112 of the housing cover 11*a*. A matching recess 132 and a cylindrical post 130 are provided in face 129. An arcuate slot 128 in recess 132, similar to arcuate slot 110 in recess 114 in the housing cover 11*a*, provides access to the interior of the housing 126 with the accessory module device housing 126 in place over the coupling member 118 and affixed to the housing 11, bosses 134, 136 are then similarly coupled to move, or be moved by, the pin 100. The coupling member bosses 134, 136 are configured to extend into the housing 126, and to engage with a pair of boss-accepting passages 138, 140 (see also FIGS. 8–11) in a rotor 142 mounted within the housing 126.

Figure 7:
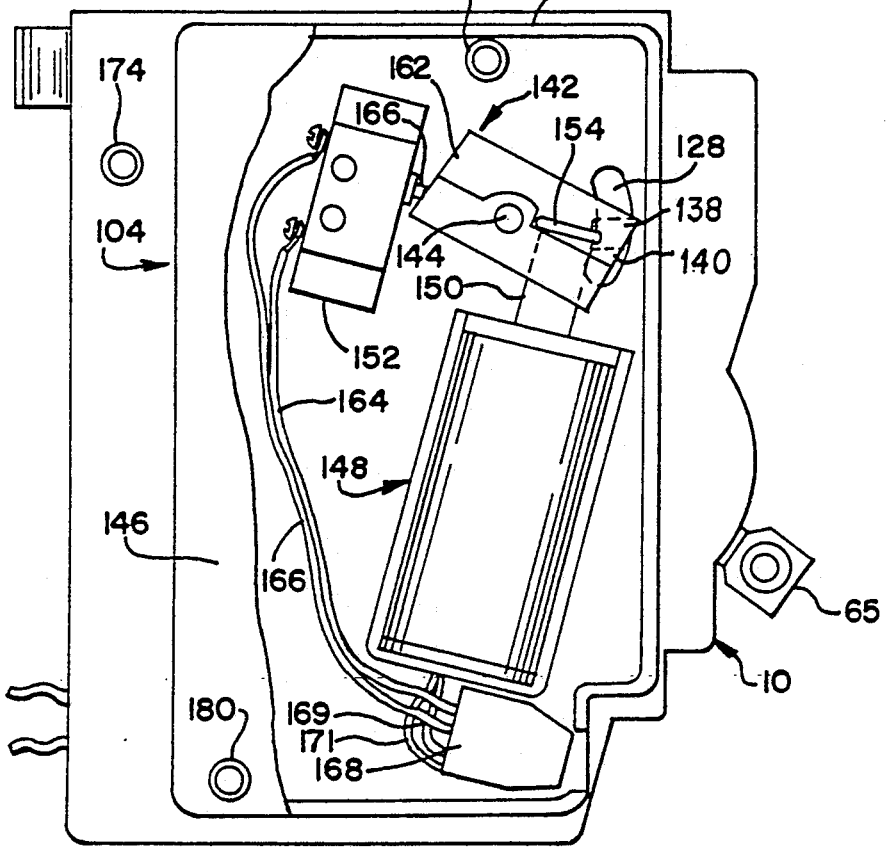
FIG. 7 is a partially cutaway plan view of the modular assembly shown in FIG. 6 affixed to the breaker.
Figure 9:
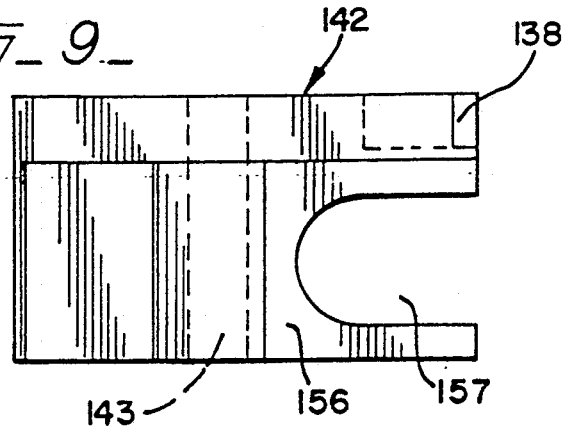
FIGS. 8–11 are various views of a rotor used in the modular assembly of FIG. 7.
Figure 8:
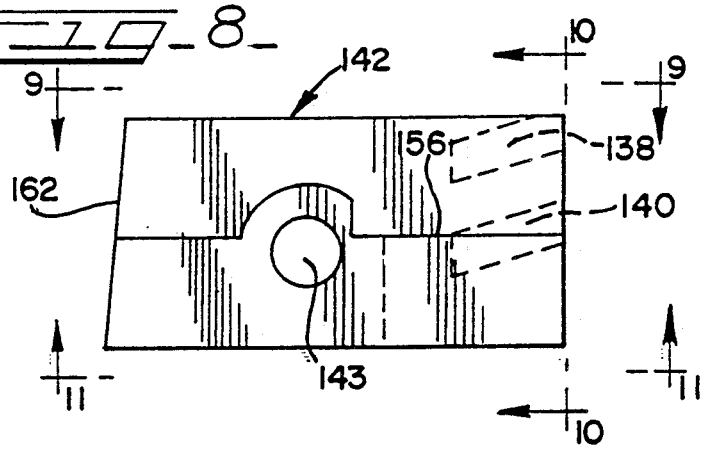
Figure 11:
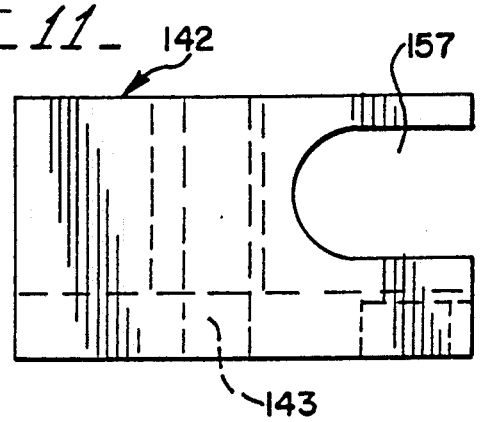
Figure 10:
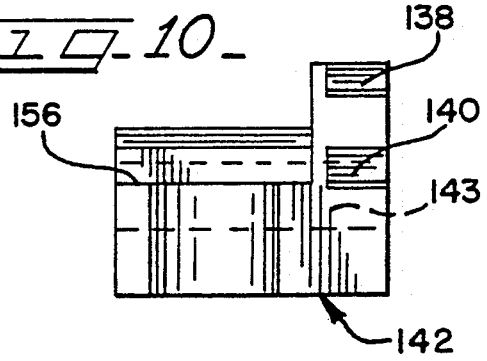

The breaker housing 11 and cover are preferably held together by hollow rivets 172, 174, 176 (FIGS. 6, 7). The accessory module housing 126 and rear wall 146 are similarly assembled by means of hollow rivets 180, 190 positioned so that through bolts may be passed between both the accessory module 104 and the breaker 10 to assemble the units together. In the alternative, self-tapping screws may be employed, or the units may be hot-staked together.

Referring FIGS. 7 through 11, the rotor 142 is rotatably secured about a central passage 143 by an interior mounting post 144 extending outward from the interior of the housing 126. The rotor 142 is secured in place by the rear housing wall 146. Disposed in the housing 126 are a solenoid coil 148, coupled to a plunger 150 adopted to rotate the rotor 142 and thus trip the breaker, and a micro-switch 152 disposed to sense the position of the rotor 142. The plunger 150 has a shoulder flange 154 at its outer end. The plunger 150 extends through a plunger passage 157 in the rotor 142, and the shoulder flange 154 engage a face 156 on the rotor 142. The plunger 150 has no spring bias and is freely movable and within the solenoid coil 148. Therefore the rotor 142 is readily moved by movement of the pin 100 when the breaker is reset or tripped by overcurrent. Because of the absence of bias on the plunger, the plunger is not moved by movement of the rotor 142 imparts no motion to the plunger 150 tripping. Retraction of the plunger 150, however will trip the breaker by rotating the rotor 142 clockwise to move pin 100.

The micro-switch 152 is positioned so that its actuating member 166 will be engaged by a camming surface 162 on the rotor 142 when the rotor 142 is carried to its extreme clockwise position during normal tripping of the breaker, either by thermal means, or by means of actuation of the solenoid 148. The micro-switch is connected by leads 164-165 to a connector block 168. Similarly, the solenoid coil 148 is connected by leads 169, 171 to the connector block 168. Remote sensing of the state of the breaker may thus be obtained via the connector block 168, and remote tripping of the breaker may be carried out by applying an appropriate control signal to the connector block 168.

Alternatively, the micro-switch 152 may be connected in series with the solenoid coil 148 and opened responsive to movement of the rotor 142 upon solenoid-induced tripping of the breaker assembly 40. The solenoid coil is thus self-de-energizing when so employed, and is therefore not subject to burnout by over-excitation. A very small solenoid coil 148 may thus be used. Such a feature may also be achieved by providing a second micro-switch affixed to the opposite side of the breaker housing 11 and similarly coupled to the pin 100. In such an arrangement, one achieves not only solenoid de-energization but also a blade position indication. It is equally evident that the micro-switch 152 could be configured as a double-pole single-throw unit incorporating such a feature.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A surface-mountable accessory module for a circuit breaker having a breaker housing with a breaker assembly disposed therein for alternately making and breaking contact with a stationary contact via a movable contactor, releasable latch means for automatically operating said breaker assembly to a circuit-breaking position, position-indicating means carried with said contactor for indicating the position of said contactor and including means responsive to a force applied to said position-indicating means for operating said breaker assembly to said circuit-breaking position, said breaker housing having an aperture for providing external access to said position-indicating means, said module comprising:

a module housing;

mounting means adapted for mounting said module housing to said breaker housing, said module housing being provided with a module housing aperture disposed to confront said breaker housing aperture when said module housing is mounted on said breaker housing;

switch means disposed within said module housing and operable between first and second switching conditions for indicating circuit-making and circuit-breaking contactor positions respectively;

coupling means for coupling said switch means to said position-indicating means when said module housing is mounted on said breaker housing to operate said switch means to said first switching condition when said contactor is in said circuit-making position and to said second switching condition when said contactor is in said circuit-breaking position, said coupling means including a coupling member disposed to pass through said module housing aperture;

solenoid means disposed within said module housing for urging said coupling member to operate said breaker assembly to said circuit-breaking position when said module is mounted on said breaker; and connector means for making electrical connection to said solenoid means and said switch means.

2. The module of claim 1 wherein said mounting means includes means for removably mounting said module housing to said breaker housing.

3. The module of claim 1 wherein said contactor moves along an arcuate path between circuit-making and circuit-breaking positions, said position-indicating means moves along an arcuate path in a first direction responsive to movement of said contactor towards said circuit-breaking position and responds to a force applied thereto in said first direction to operate said breaker assembly to said circuit-breaking position, said coupling means includes a rotor rotatably mounted within said module housing and configured to operate said switch means between said first and second switching conditions by rotation of said rotor, said coupling member being configured for engagement with said rotor to be rotatably moved therewith and being adapted for engagement with said position-indicating means of said breaker, and said coupling means including means responsive to energization of said solenoid means for rotating said coupling member in said first direction.

4. The module of claim 3 wherein said switch means includes means for disconnecting said solenoid means from said connector means responsive to rotation of said rotor in said first direction.

5. The module of claim 3 wherein an outer wall of said module housing through which said module housing aperture passes is configured with a recess containing said housing aperture, and said coupling member is a generally planar member configured to be partially disposed within said module housing recess and rotatably movable therein when said module is mounted to said breaker housing, said coupling member having portions extending from one major face thereof configured to engagement with said rotor and portions extending from the opposite major face thereof configured for engagement with said position-indicating means.

6. The module of claim 5 further including mounting means for mounting said coupling member for rotation within said module recess.

7. A circuit breaker and accessory comprising:

a circuit breaker housing;

a circuit breaker assembly disposed within said housing for alternately making and breaking contact with a stationary contact via a movable contactor, said assembly including releasable latch means for automatically operating said breaker assembly to a circuit-breaking position, position-indicating means carried with said contactor for indicating the position of said contactor and including means responsive to a force applied to said position-indicating means for operating said breaker assembly to said circuit-breaking position, said breaker housing having an aperture for providing external access to said position-indicating means;

a module housing mounted to said breaker housing, said module housing having a module housing aperture disposed to confront said breaker housing aperture;

switch means disposed within said module housing and operable between first and second switching conditions for indicating circuit-making and circuit-breaking contactor positions respectively;

coupling means for coupling said switch means to said position-indicating means when said module housing is mounted on said breaker housing to operate said switch means to said first switching condition when said contactor is in said circuit-making position and to said second switching condition when said contactor is in said circuit-breaking position, said coupling means including a coupling member disposed to pass through said module housing aperture;

solenoid means disposed within said module housing for urging said coupling member to operate said breaker assembly to said circuit-breaking position; and connector means for making electrical connection to said solenoid means and to said switch means.

8. The circuit breaker and accessory of claim 7 including mounting means for removably mounting said module housing on said breaker housing.

9. The circuit breaker and accessory of claim 8 wherein said contactor moves along an arcuate path between said circuit-making and circuit-breaking positions, said position-indicating means moves along an arcuate path in a first direction responsive to movement of said contactor towards said circuit-breaking position and responds to a force applied thereto in said first direction to operate said breaker assembly to said circuit-breaking position, said coupling means includes a rotor rotatably mounted within said module housing and configured to operate said switch means between said first and second switching conditions by rotation of said rotor, said coupling member is configured for engagement with said rotor to be rotatably moved therewith and is adapted for engagement with said position-indicating means of said breaker, and said coupling means includes means responsive to energization of said solenoid means for rotating said coupling member in said first direction.

10. The circuit breaker and accessory of claim 9 wherein said switch means includes means for disconnecting said solenoid means from said connector means responsive to rotation of said rotor in said first direction.

11. The circuit breaker and accessory of claim 9 wherein an outer wall of said module housing through which said module housing aperture passes is configured with a recess containing said housing aperture, and said coupling member is a generally planar member configured to be partially disposed within said module housing recess and rotatably movable therein, said coupling member having portions extending from one major face thereof configured for engagement with said rotor and portions extending from the opposite major face thereof configured for engagement with said position-indicating means.

12. The circuit breaker and accessory of claim 11 further including mounting means for mounting said coupling member for rotation within said module recess.

13. The circuit breaker and accessory of claim 11 wherein an outer surface of said breaker housing is provided with a recess configured as a circular sector containing said breaker housing aperture.

14. An electrical circuit breaker comprising:

a circuit breaker housing having an outer surface provided with a recess configured as a circular sector;

a breaker assembly within said housing for alternately making and breaking contact with a stationary contact via a movable contactor, said contactor mounted for movement along an arcuate path between a circuit-making and a circuit-breaking position, said position-indicating means moving along an arcuate path in a first direction responsive to movement of said contactor towards said circuit-breaking position and responding to a force applied thereto in said first direction to operate said breaker assembly to said circuit-breaking position, said assembly including releaseable latch means for automatically operating said breaker assembly to said circuit-breaking position, position-indicating means carried with said contactor for indicating the position of said contactor and including means responsive to a force applied to said position-indicating means for operating said breaker assembly to said circuit-breaking position and said recess in breaker housing having an aperture for providing external access to said position-indicating means.

15. The circuit breaker of claim 14, further including:

a module adapted for coupling to said circuit breaker and including an aperture juxtaposed to said breaker housing aperture; and a coupling member for coupling said position-indicating means in said breaker with said module via said aperture.

* * * * *